US008091704B2

(12) United States Patent
Trigg

(10) Patent No.: US 8,091,704 B2
(45) Date of Patent: Jan. 10, 2012

(54) PERFORATED BLISTER PACKAGING

(75) Inventor: Larry Trigg, Santa Clara, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/937,885

(22) PCT Filed: May 28, 2008

(86) PCT No.: PCT/US2008/065002
§ 371 (c)(1),
(2), (4) Date: Oct. 14, 2010

(87) PCT Pub. No.: WO2009/145765
PCT Pub. Date: Dec. 3, 2009

(65) Prior Publication Data

US 2011/0031150 A1 Feb. 10, 2011

(51) Int. Cl.
*B65D 73/00* (2006.01)

(52) U.S. Cl. ..... 206/469; 206/467; 206/470

(58) Field of Classification Search ..... 206/461, 206/462, 469, 532, 467, 470; 229/221, 210, 229/220, 242
See application file for complete search history.

(56) References Cited

U.S. PATENT DOCUMENTS

| | | | | | |
|---|---|---|---|---|---|
| 2,993,590 | A * | 7/1961 | Denton | 206/469 |
| 3,255,880 | A * | 6/1966 | Grossman | 206/469 |
| 3,303,930 | A * | 2/1967 | Hyland | 206/462 |
| 3,428,171 | A * | 2/1969 | Blish | 206/469 |
| 3,912,082 | A * | 10/1975 | Gerner et al. | 206/531 |
| 4,119,203 | A * | 10/1978 | Kuchenbecker | 206/461 |
| 4,210,246 | A * | 7/1980 | Kuchenbecker | 206/461 |
| 4,569,442 | A * | 2/1986 | Bushey | 206/469 |
| 5,209,354 | A * | 5/1993 | Thornhill et al. | 206/469 |
| 6,276,529 | B1 * | 8/2001 | Feehan, Jr. | 206/469 |
| 6,364,113 | B1 * | 4/2002 | Faasse et al. | 206/469 |
| 2001/0007308 | A1 * | 7/2001 | Glassman | 206/469 |

FOREIGN PATENT DOCUMENTS

| | | |
|---|---|---|
| FR | 2745798 | 9/1997 |
| JP | 10-181769 | 7/1998 |
| JP | 2006-027715 | 2/2006 |

OTHER PUBLICATIONS

International Searching Authority, International Search Report and The Written Opinion, 12 pages, Jan. 2009.

* cited by examiner

*Primary Examiner* — David Fidei

(57) ABSTRACT

A blister package includes a plastic blister being between top and bottom covers. The plastic blister further includes a perforation that partially extends around a product enclosure. A cut line intersects the perforation along an interior portion of the plastic blister to provide a location for tearing the product enclosure from the plastic blister.

14 Claims, 4 Drawing Sheets

PERFORATED BLISTER PACKAGING

FIELD OF THE INVENTION

The present invention relates to enclosing and packaging products and, more specifically, to a blister package.

BACKGROUND

Electronic devices and other products are often enclosed and sold in plastic packaging. A clamshell design consists of either two pre-formed plastic sheets or one sheet folded over onto itself and fused at the edges. These designs are typically used for theft-prone products such as consumer electronics. The plastic housing is strong and durable to deter tampering and theft, and a sharp knife is usually required to cut through the plastic packaging to access the product.

Vendors use plastic packaging such as clamshells because they secure the product and deter tampering and theft. This packaging, however, is often not consumer friendly. In some plastic packaging, the product is tightly sealed and quite difficult to access even with a sharp knife.

DETAILED DESCRIPTION

Exemplary embodiments are directed to apparatus and methods for enclosing and packaging products.

In one embodiment, a blister package includes a plastic blister positioned between a top cover and a bottom cover. The plastic blister is a one piece blister that extends all or substantially all the way around the blister package between the two covers.

The plastic blister includes a perforation removed from a corner where a vertical portion of the plastic blister meets a horizontal surface of the plastic blister. This perforation is placed on the horizontal surface away from the corner so sheer force imparted on the vertical surface by a user is not sufficient to separate the perforation to remove the product. Instead, shear force is used to separate the plastic blister and access the product after the plastic blister is cut along a cut line. Since the required tension force is greater than the sheer force, a user is prevented from accessing the product without a tool to cut the cut line.

The perforation extends around three sides or walls of a blister housing that encloses the product. Further, while the product is enclosed in the blister package, the top cover hides or conceals the perforation from view. In one embodiment, the top and bottom covers are glued to the plastic blister to prevent a user from accessing the product while the product remains in the store.

Instructions are provided on an exterior surface of the top cover to instruct the user to cut along a cut line that extends across the blister package along an un-perforated side of the blister housing. Once a user cuts across this cut line, a portion of the plastic blister (i.e., the portion not housing the product) falls away. With the perforation edges now exposed, shear force is now used to rip the plastic blister along the perforation and provide access to the product. The back cover is provided with a visual tab to show the user where to pull once the cut occurs across the cut line.

Figure 1:
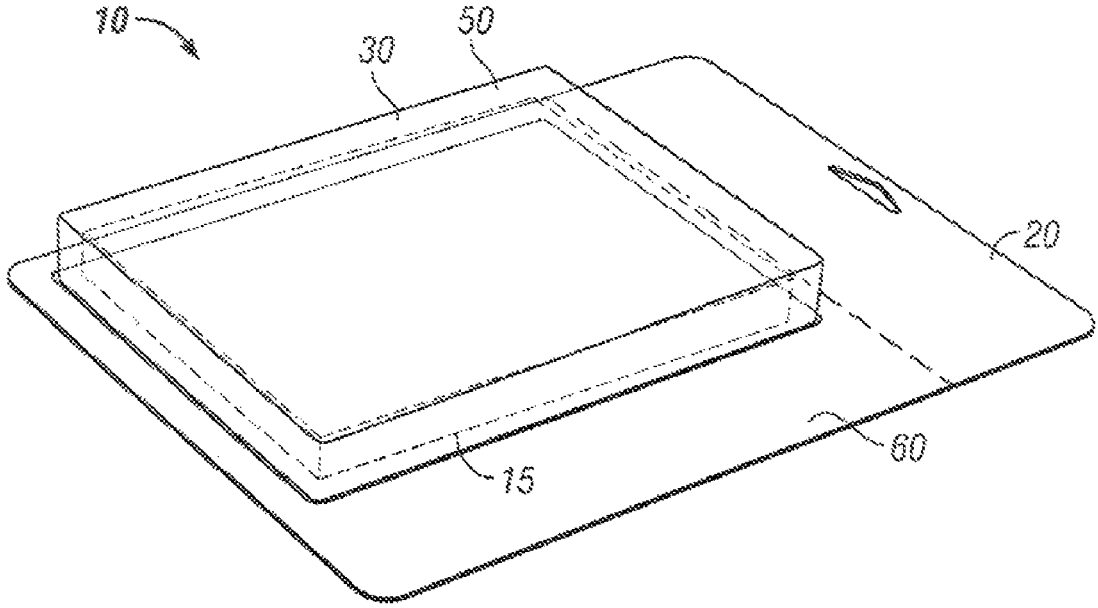
FIG. 1 is an assembled view of a blister package with a product in accordance with an exemplary embodiment.
Figure 2:
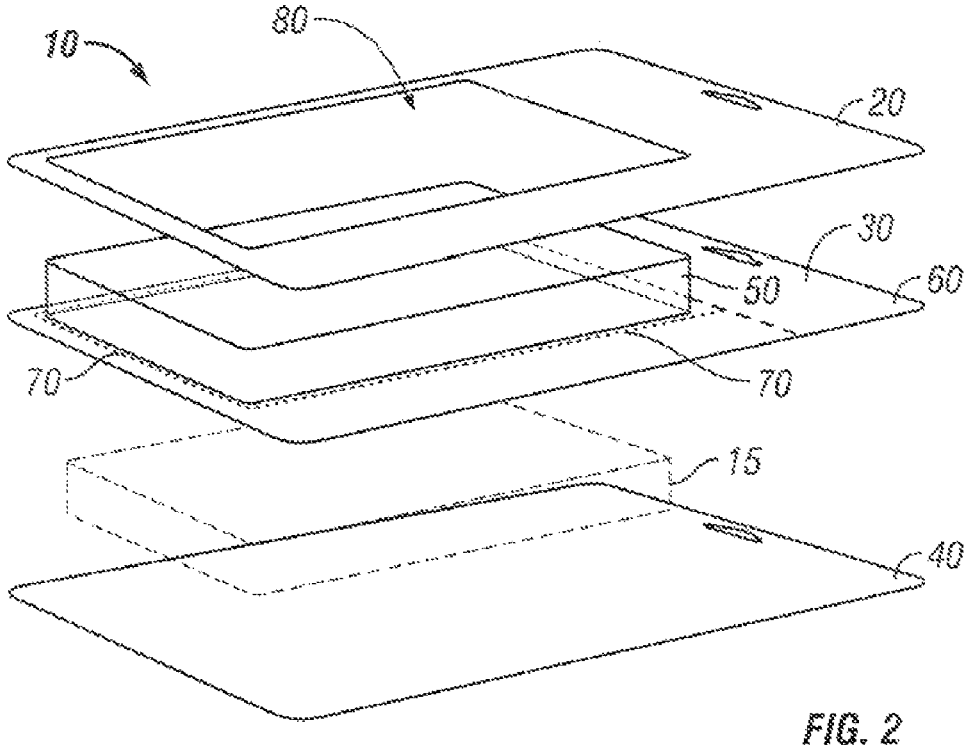
FIG. 2 is an exploded view of the blister package with the product in accordance with an exemplary embodiment.

FIGS. 1 and 2 show a blister a blister package 10 with a product 15 in accordance with an exemplary embodiment. The blister package includes a top cover 20, a plastic blister 30, and a bottom cover 40.

In one exemplary embodiment, the top cover 20 and bottom cover 30 have a thin body with two oppositely disposed flat sides. The covers are formed of materials that include, but are not limited to, plastic, paper, paperboard, cardboard, and other material suitable for packaging products.

The plastic blister 30 includes a body with two sections: a product enclosure 50 and a package support 60. These two sections are separable from each other along a perforation 70 to provide access to the product 15.

In one exemplary embodiment, the plastic blister 30 is formed from a clear pre-formed plastic, such as polyethylene tetrachloride (PET). Depending on the design, the plastic blister can include various attributes, such as being transparent so the product 15 can be easily seen and examined, vacuum-formed around a mold to snugly enclose the product, and provided with space so the product can be opened upon purchase.

The size and shape of plastic blister 30 varies depending on the product being enclosed, and exemplary embodiments are not limited to any particular size and shape. Furthermore, exemplary embodiments are not limited to any particular type of product. By way of example, such products include, but are not limited to, consumer electronic devices, toys, hardware, pharmaceutical products, consumer goods, etc.

Connection between the plastic blister 30, top cover 20, and bottom cover 40 can occur using a variety of techniques. For example, plastic blister 30 is affixed to the bottom cover 40 using heat and pressure to activate an adhesive (heat seal coating) on the bottom cover.

As best shown in FIGS. 1 and 2, the plastic blister 30 is sandwiched or positioned between the top cover 20 and the bottom cover 40. Top cover 20 includes a hole or opening 80 that is sized and shaped to receive the product enclosure 50. In other words, the product enclosure 50 fits through the opening 80 such that the top cover 20 lies flat against a first or top surface of the package support 60. In one exemplary embodiment, the top cover 20 covers all or substantially all of a surface area of the package support 60.

The bottom cover 40 is sized and shaped to cover the product enclosure 50. Specifically, the bottom cover 50 lies flat against a second or bottom surface of the package support 60.

As best shown in FIG. 2, the top cover 20 and bottom cover 40 have an overall similar size and geometric shape. For illustration, both covers are shown as being rectangular in shape, with the top cover 20 including the opening 80 not included in the bottom cover 40. Further, as best shown in FIG. 2, the top cover 20 and the package support 60 also have a similar size and geometric shape.

Figure 3A:
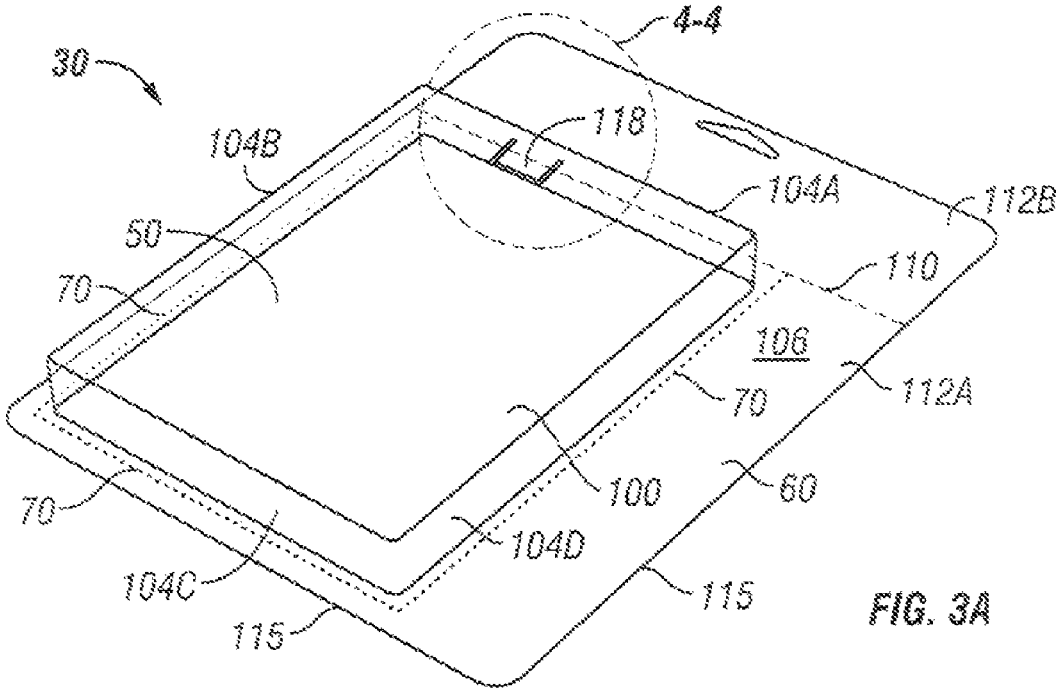
FIG. 3A is a top view of a plastic blister of the blister package in accordance with an exemplary embodiment.
Figure 3B:
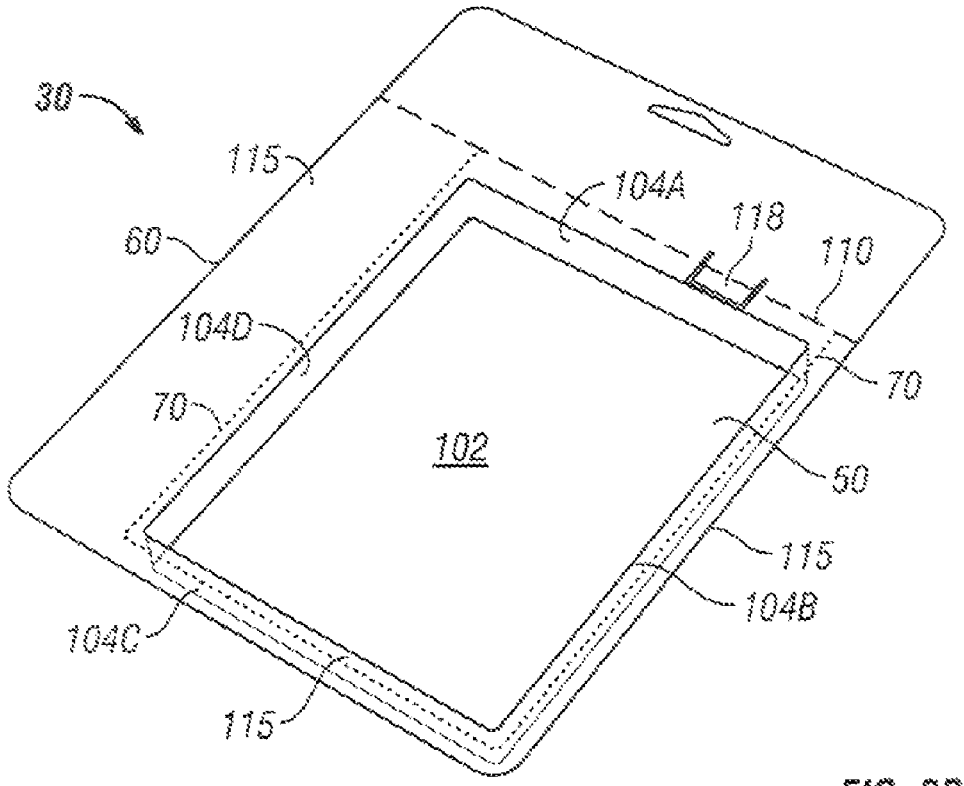
FIG. 3B is a bottom view of the plastic blister of the blister package in accordance with an exemplary embodiment.

FIGS. 3A and 3B show the plastic blister 30 in more detail. The product enclosure 50 forms a blister housing 100 that has a three-dimensional shape to house or contain the product. For illustration, this housing has a rectangular shape that includes a top surface 102 and four sidewalls or side surfaces 104A-104D. These sidewalls extend upwardly or outwardly from the flat surface 106 of the package support 60.

The perforation 70 extends around the perimeter of the package support 60 of blister housing 100. In one exemplary embodiment, only three side of the blister housing 100 include an adjacent perforation. Specifically, the perforation 70 extends along surface 60 and adjacent to sidewalls 104B, 104C, and 104D. Notice area adjacent to sidewall 104A does not include the perforation. In other words, the perforation 70 only extends around a portion of the outer perimeter of the blister housing 100 such that one side (namely sidewall 104A) is not perforated.

An imaginary cut line 110 (shown as a dashed line) extends across the plastic blister 30 through the package support 60. Specifically, this cut line extends along with and adjacent to sidewall 104A of the blister housing 100. The cut line 110 represents a line or area through which a user cuts the plastic blister. In one exemplary embodiment, the cut line 110 is shown as instructions on the outer surface of the top cover (see FIG. 5).

A user can use scissors or another sharp object to cut along the cut line 110 to separate the plastic blister into two pieces or portions, shown as portion 112A and 112B. Portion 112A includes the blister housing 100, and portion 112B includes a top portion of the package support 60.

As noted, the perforations 70 do not extend completely around the blister housing 100 enclosing the product. Instead, the perforations partially extend around the blister housing. In one embodiment, the perforations do not extend to the edges 115 of the plastic blister. This prevents a user from tearing open the blister package and accessing the product without a tool. In other words, the perforations are not accessible until the top portion 1128 is removed from the bottom portion 112A.

After a user cuts along the cut line 110 (i.e., along one side of the product), the perforation 70 is accessible for tearing to access the product. Removing the top portion 112B provides access to a pull tab 118 that provides a finger-opening so a user can insert a finger and rip open the package.

Figure 4:
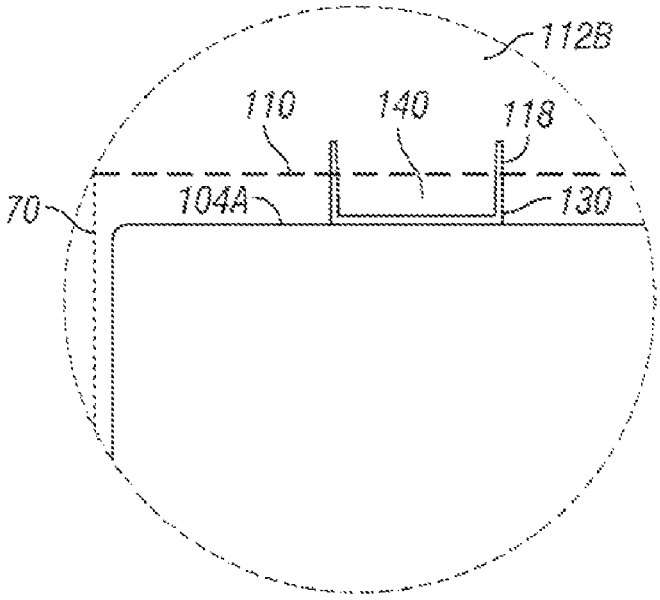
FIG. 4 is an enlarged view of a corner of the plastic blister taken along dashed lines 4-4 of FIG. 3A in accordance with an exemplary embodiment.

FIG. 4 shows an enlarged view of a corner of the plastic blister 30. An actual cut line 130 is adjacent to the sidewall 104A to form tab 118. This cut line 130 extends through both the plastic blister and top and bottom covers (see FIGS. 1 and 2) of the blister package. As such, once a user cuts across the imaginary cut line 110, a portion 140 of the blister package will fall away Exposing area 140 (a finger-hole) or opening for enabling the user to separate the product enclosure from the package support along the perforation 70. The hole is placed close in proximity to either side of the perforation 70 to allow easier starting of ripping action.

For illustration and discussion purposes, FIG. 4 is discussed with some exemplary dimensions. Exemplary embodiments are not limited to any particular dimension or range of dimension since such dimensions can vary depending on, for example, the size and shape of the product being packaged, strength and type of materials being used in the blister package, intended ease of opening the product, etc.

In one exemplary embodiment, the perforation 70 is between about 2.0 millimeters (mm) and 3.5 mm away from an adjacent sidewall (such as sidewalls 104B, 104C, and 104D being shown in FIGS. 3A and 3B). In another exemplar, embodiment, the perforation is located at least 1.5 mm away from a wall or boundary formed by the enclosure housing the product.

The perforation is located away from a juncture where the sidewall meets the bottom surface 106 (FIG. 3A). This separation of the perforation 70 and the sidewall prevents a user from separating the product enclosure 50 from the package support 60 without a tool, such as scissors. As such, a person is prevented from accessing or tampering with the product before the product is purchased. If a user attempts to separate the product enclosure 50 from the package support 60, the pulling or separation force exerted by the user will not be sufficient to open the product since the perforation 70 is removed from the juncture of the sidewall enclosing the product. With perforation on surface 70, opening forces will be of tension forces and not shear forces. Tension forces in this embodiment are stronger than shear forces preventing opening without scissors.

Figure 5:
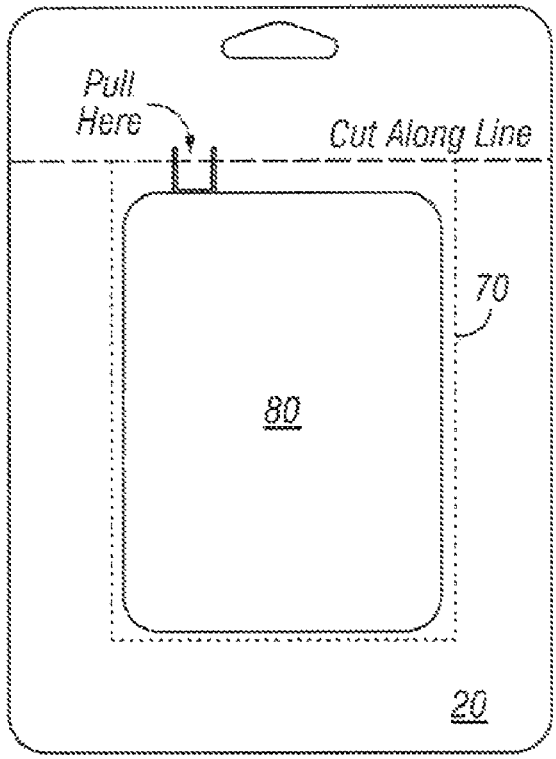
FIG. 5 is a plan view of a printed side of a top cover of the blister package in accordance with an exemplary embodiment.

In one exemplary embodiment, the perforations on the plastic blister are hidden from view when the product is assembled in the blister package. FIG. 5 shows a printed side of the top cover 20. Looking to FIGS. 1, 3A and 5, a size of opening 80 is large enough to receive the blister housing 100. This opening, however, is small enough to cover the perforations 70 when the top cover 20 is positioned on top of the plastic blister 30. FIG. 5 shows the perforations 70 in phantom to indicate where the perforations exist with respect to the opening 80 when the top cover 20 is placed over the plastic blister 30.

Figure 6:
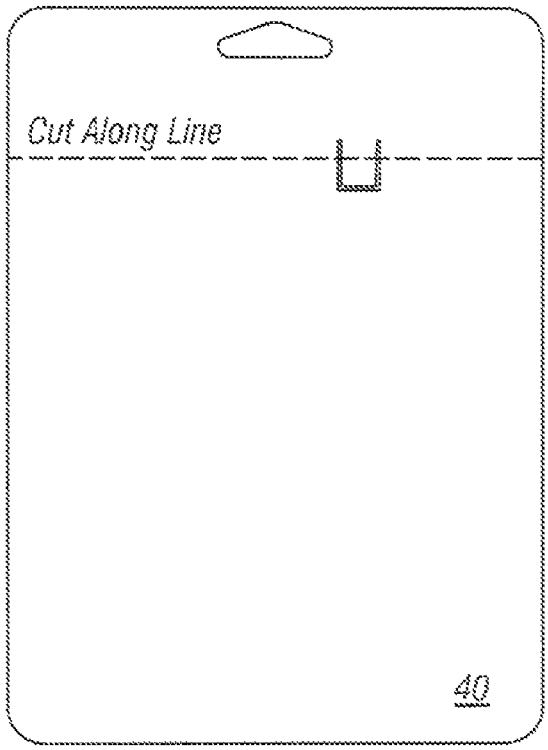
FIG. 6 is a plan view of a printed side of a back cover of the blister package in accordance with an exemplary embodiment.

As shown in FIGS. 5 and 6, the top cover 20 and bottom cover 40 are provided with indicia (such as words, symbols, etc.) to instruct a user how to open the blister package and remove the product. As shown, a user is instructed to cut along a line ("cut along line") and then pull a tab ("pull here").

Figure 7:
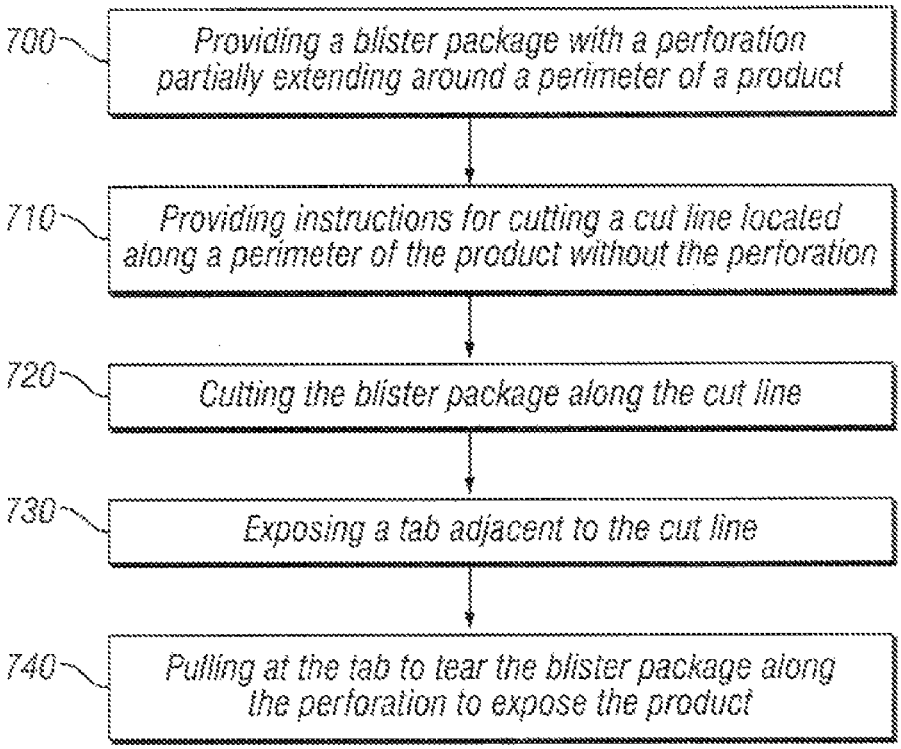
FIG. 7 is a flow diagram for removing a product from the blister package in accordance with an exemplary embodiment.

FIG. 7 is a flow diagram for removing a product from a blister package in accordance with an exemplary embodiment.

According to block 700, a blister package is provided with a perforation that partially extends around a perimeter of a product. For example, the perforation extends around three side of the product and is limited to an interior area of the plastic blister. In other words, the perforation does not extend to edges of the packaging to prevent a user from ripping or tearing the perforation with only the use of his or her hands. Furthermore, the perforation is hidden from view with one or more covers, such as cardboard covers.

According to block 710, instructions are provided on the blister package for cutting a cut line that is located along the perimeter top of the product without the perforation. The cut line is provided along the side of the product that is devoid of the perforation.

According to block 720, the blister package is cut along the perforation. Since the cut line extends through or meets the perforation, the perforation now extends to an edge of the blister package (i.e., the newly formed edge created by removing a portion of the blister package). For example, FIG. 5 shows the perforation contacting the cut line in two separate locations.

According to block 730, a tab adjacent to the cut line is exposed. Access to this tab is provided only when the blister package is cut along the cut line. The tab provides a location or opening for a user to grip the package to remove the product.

According to block 740, the user pulls at the tab to tear the blister package along the perforation to expose the product.

Sheer force is now able to be used to easily rip open the blister package along the perforation.

As used herein and in the claims, the following words are defined as follows:

The term "blister package" means a pre-formed plastic packaging for enclosure small consumer goods.

The methods in accordance with exemplary embodiments of the present invention are provided as examples and should not be construed to limit other embodiments within the scope of the invention. For instance, blocks in diagrams or numbers (such as (1), (2), etc.) should not be construed as steps that must proceed in a particular order. Additional blocks/steps may be added, some blocks/steps removed, or the order of the blocks/steps altered and still be within the scope of the invention. Further, methods or steps discussed within different figures can be added to or exchanged with methods of steps in other figures. Further yet, specific numerical data values (such as specific quantities, numbers, categories, etc.) or other specific information should be interpreted as illustrative for discussing exemplary embodiments. Such specific information is not provided to limit the invention.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A blister package, comprising:

a top cover;

a bottom cover; and a plastic blister having a product enclosure and a package support, the package support being a plastic flange extending around the product enclosure positioned between the top and bottom covers, wherein a perforation in the package support extends only partially around the product enclosure from a first location to a second location on a cut line indicated on the top cover and extends along a portion of the product enclosure between two edges of the package support, the first location being different than the second location, and wherein the perforation is located on an interior portion of the plastic blister and does not extend to edges of the plastic blister.

2. The blister package of claim 1, wherein the top cover visibly covers the perforation while the product is enclosed in the product enclosure.

3. The blister package of claim 1, wherein the perforation only extends around three sides of the product enclosure.

4. The blister package of claim 1, wherein the perforation is located between 2.0 millimeters (mm) and 3.5 mm from sidewalls that extend outwardly to form the product enclosure.

5. The blister package of claim 1 further comprising, a tab that falls away from the blister package when the blister package is cut along the cut line extending between two edges of the package support.

6. The blister package of claim 1, further comprising a cut through the plastic blister and top and bottom covers, the cut located to intersect the cut line at two locations between the first and second locations and extend extending partially around an area defining a pull tab, the area defining the pull tab being located between the cut line and the product enclosure.

7. The blister package of claim 6, wherein the area defining the pull tab being located on the package support in proximity to the perforation.

8. A blister package, comprising:

a plastic blister including a product enclosure for enclosing a product, a flat package support being a plastic flange adjacent the product enclosure, and a perforation that extends on the flat package support only partially around the product enclosure without extending to an edge of the plastic blister, the perforation intersecting a cut line indicated on a top cover at two different points, the cut line extending to an edge of the plastic blister and being along a portion of the product enclosure around which the perforation does not extend;

the top cover attached to a first side of the plastic blister and visibly covering the perforation; and a bottom cover attached to a second side of the plastic blister.

9. The blister package of claim 8, wherein the perforation is located at least 1.5 millimeters away from the product enclosure to prevent a user from accessing the product without a sharp tool.

10. The blister package of claim 8 wherein the cut line is indicated on the top cover, the cut line indicating a location to cut the plastic blister to expose the perforation.

11. The blister package of claim 8, wherein the perforation only extends along three sides of the product enclosure and the cut line extends along a fourth side of the produce enclosure.

12. The blister package of claim 8 further comprising, a tab cut into the plastic blister, wherein the tab provides an opening for a finger of user to pull the product enclosure away from the blister package.

13. The blister package of claim 8 further comprising, a portion that falls away from the blister package to expose an opening to grip and tear apart the product enclosure.

14. The blister package of claim 8, wherein the top cover is formed of cardboard and includes an opening through which the product enclosure extends.

* * * * *